United States Patent [19]

Rozeboom

[11] 4,369,927

[45] Jan. 25, 1983

[54] SELF-LOADING FEED MIXER AND TRANSPORT APPARATUS WITH IMPROVED GRINDING AND LOADING MECHANISM

[76] Inventor: Antonie G. Rozeboom, R.R. No. 1, Doon, Iowa 51235

[21] Appl. No.: 161,307

[22] Filed: Jun. 20, 1980

[51] Int. Cl.[3] ..... B02C 13/26

[52] U.S. Cl. ..... 241/73; 241/101.7; 241/194

[58] Field of Search ..... 241/101.7, 73, 186 R, 241/186 A, 189 R, 194, 195, 101 B, 280, 281, 282, 60, 101.4, 285 R, 285 A

[56] References Cited

U.S. PATENT DOCUMENTS

| | | | |
|---|---|---|---|
| 394,431 | 12/1888 | Barret . | |
| 1,035,288 | 8/1912 | Williams . | |
| 2,676,721 | 4/1954 | Hansen . | |
| 2,815,941 | 12/1957 | Schmale . | |
| 2,894,733 | 7/1959 | Wosmek . | |
| 3,021,121 | 2/1962 | Moss et al. . | |
| 3,084,821 | 4/1963 | Knight . | |
| 3,286,862 | 11/1966 | Hansen . | |
| 3,370,796 | 2/1968 | Herr | 241/186 X |
| 3,409,155 | 11/1968 | Hamlet . | |
| 3,421,740 | 1/1969 | Behrens . | |
| 3,465,801 | 9/1969 | Forster . | |
| 3,501,101 | 3/1970 | Lindstrom | 241/98 |
| 3,556,418 | 1/1971 | Hokana | 241/186 R X |
| 3,604,688 | 9/1971 | Schuler . | |
| 3,638,920 | 2/1972 | Davis . | |
| 3,687,322 | 8/1972 | Stieren . | |
| 3,688,827 | 9/1972 | Ryan . | |
| 3,779,408 | 12/1973 | Ivie | 241/101.7 X |
| 3,790,138 | 2/1974 | Neier . | |
| 3,926,378 | 12/1975 | Ryan | 241/101 A X |
| 3,961,718 | 6/1976 | Lucas | 241/101.7 X |
| 3,979,074 | 9/1976 | White et al. | 241/186 R X |
| 4,060,961 | 12/1977 | Anderson et al. | 241/194 X |
| 4,071,226 | 1/1978 | Miller . | |
| 4,082,198 | 4/1978 | Anderson et al. | 241/101.7 X |
| 4,151,961 | 5/1979 | Makofka et al. | 241/186 R X |
| 4,198,799 | 4/1980 | McGrath | 241/73 X |

*Primary Examiner*—Mark Rosenbaum

*Attorney, Agent, or Firm*—Charles P. Boukus, Jr.

[57] ABSTRACT

A self-loading feed mixer and transport wagon is provided which is capable of grinding and loading a stack of livestock feed material into the wagon, thoroughly mixing the feed material together, and transporting the feed material to a desired location where it is dispensed from the wagon. The wagon includes a feed grinding and loading mechanism which is vertically adjustable to engage the stack of feed material at different levels. The feed grinding and loading mechanism comprises an open-faced housing which contains a rotatable shaft provided with a plurality of hammer units and a concave screen spaced from the shaft and cooperable with the hammer units to grind the feed material. The grinding and loading mechanism includes a grapple fork pivotally mounted on the housing and adapted to urge the feed material through the open-faced housing into engagement with the pulverizing hammers. The grapple fork is provided with a shield which serves as a protective cover to close the open-faced housing. The ground feed material is fed via a blower unit and flexible spout into the feed compartment of the wagon. Preferably, an auger mechanism is provided at the top of the feed compartment which uniformly distributes the ground feed material along the compartment.

24 Claims, 16 Drawing Figures

Fig. 4
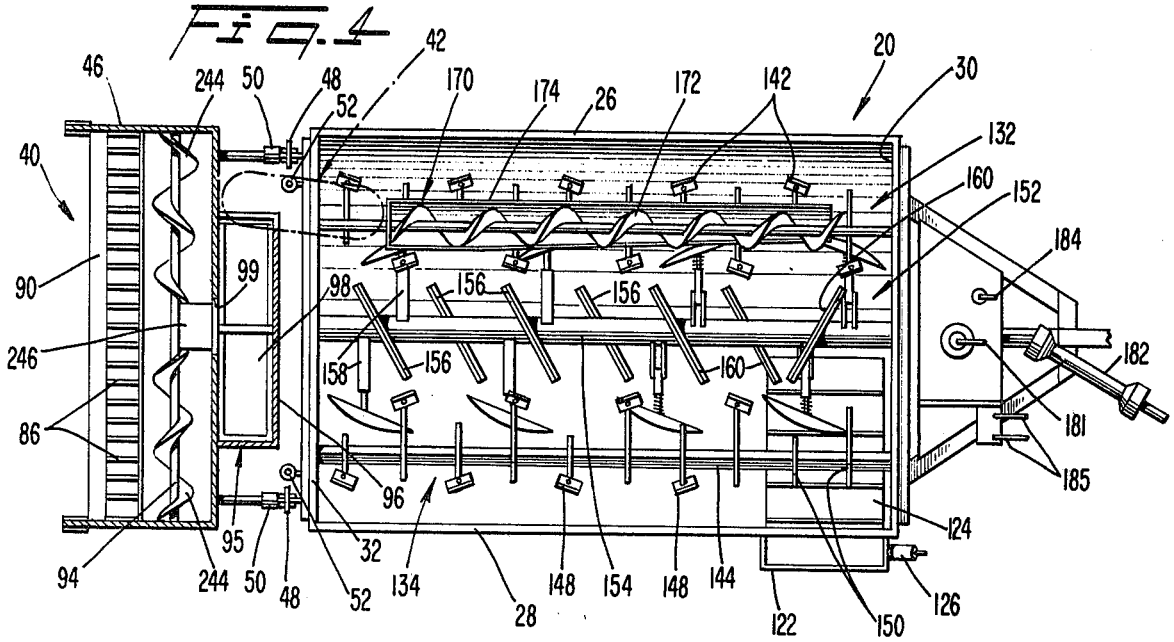
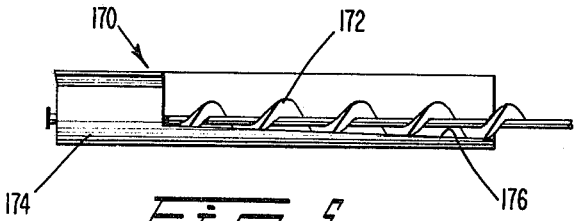
Fig. 5
Fig. 6
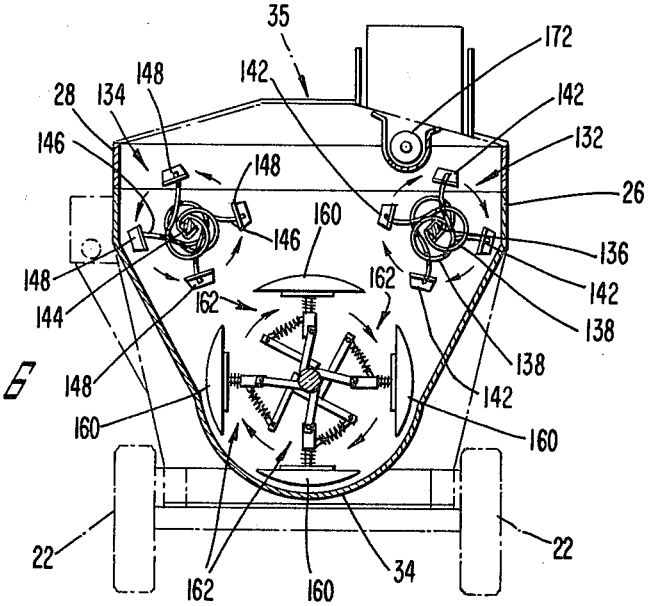

SELF-LOADING FEED MIXER AND TRANSPORT APPARATUS WITH IMPROVED GRINDING AND LOADING MECHANISM

FIELD OF THE INVENTION

The present invention relates to a feed mixer apparatus and, more particularly, to a self-loading feed mixer and transport vehicle capable of grinding and mixing different livestock feed materials together. Specifically, the invention provides a self-loading feed mixer and transport vehicle capable of grinding and loading a stack of feed or bedding material, e.g., hay, straw or silage, thoroughly mixing the material together, and transporting the material to a desired location where it can be spread on the ground or dispensed into a feed bunk or storage unit.

DESCRIPTION OF THE PRIOR ART

Historically, hay making and feeding operations on farms have required a significant amount of manual labor. At one time, horse drawn hay loaders were pulled through fields of mowed hay to rake and load the hay into stacks. Such a loader required not only a driver, but also one or more farm hands standing on the loader and using pitchforks to properly stack the hay. Unloading and feeding operations with such loaders were also performed manually.

More recently, modern machines have been developed to automate the handling and feeding of hay and silage to livestock. It is now customary to windrow mown hay into long parallel rows in the field to facilitate subsequent handling operations. After drying of the windrows, bale making machines are towed by tractors along the windrows to collect and form the hay into bales. Various types of hay baling machines are known which form the hay into small rectangular bales or large round bales which are wrapped by twine. The small rectangular bales can be immediately loaded into a bale accumulator or can be left in the fields and picked up by a tractor loader or bale wagon. The bales are brought to a shed or barn for storage until needed. When it is desired to feed the hay to livestock, the bales can be placed next to the fence of a livestock enclosure and the twine removed to allow the livestock to feed on the hay. To handle the large round bales, specially designed pick-up and transport machines are required. Typically, the large round bales are brought to the livestock which feed on the bale without further processing. Again, it is necessary to remove the twine from the bales before feeding of livestock. Baling machines have also been developed which form the hay into large rectangular blocks. These blocks are typically transported over relatively long distances before the hay is fed to livestock.

In addition, tractor-operated hay stacking machines have been developed which stack the windrowed hay into giant round stacks or into loaf-shaped stacks. The stacks formed by these machines are generally left in the field and transported by stack loading and moving platforms to desired storage areas. The livestock can be allowed to feed directly on the large stacks without further processing. Alternatively, the stacks may be fed to a chopper which grinds and dispenses the hay for feeding by livestock.

After the hay is baled or stacked, further processing of the hay is desirable to provide a more palatable and nutritious livestock feed and minimize waste. For example, the bale or stack of hay may be transferred by a front end tractor loader into a tub grinder which grinds the hay into small pieces. In addition, the ground hay can be mixed with other ingredients, e.g., silage, corn meal and molasses, to produce a more palatable and nutritious feed material. Typically, the ground hay is loaded into a feed mixer wagon in which it is blended with the other ingredients. The wagon is customarily designed to dispense the mixed feed material into a feed bunk or to spread the feed material along the ground.

No single machine has been developed which satisfactorily embodies the capabilities which enable a stack of hay to be ground, loaded, mixed with other feed material, transported to a livestock feed area, and unloaded for feeding to livestock. For example, previous proposals relating to feed grain grinding and mixing vehicles are disclosed in Schmale, U.S. Pat. Nos. 2,815,914; Forster, 3,465,801; and Lindstrom, 3,501,101. In addition, Wosmek, U.S. Pat. No. 2,894,733 discloses a portable grinding and mixing device for livestock feed. The primary objective of these devices is to provide a machine which grinds, mixes and blends feed grains for livestock. Generally, such grain grinding devices are unsuccessful when applied to roughage. Moreover, these devices are not self-loading machines but include loading hoppers into which the feed grains must be moved. In contrast, the present invention is capable of grinding and loading itself simultaneously. It is not necessary for the feed material to be moved into any type of loading hopper, but rather the material is picked up, pulverized and loaded in one simultaneous operation.

Co-pending U.S. application 78,027, filed Sept. 24, 1979, now issued as U.S. Pat. No. 4,330,091 in which applicant is named as a co-inventor, discloses a self-loading feed mixer and transport apparatus which has been developed to overcome the disadvantages of the prior art machines. The self-loading mixer and transport apparatus advantageously combines the functions of grinding, loading, mixing and dispensing feed material, e.g., roughage, in a single piece of farm equipment. The apparatus eliminates the need for an expensive tub grinder previously required for grinding hay. The feed grinding and loading mechanism employed in the previous apparatus includes an open-faced housing which contains a feed pulverizing mechanism comprising a rotatable shaft provided with a plurality of pulverizing chains. Because the pulverizing chains and rotary shaft are exposed via the open-faced housing, there is a potential safety hazard associated with the operation of the machine. Although the possibility of personal injury and physical damage can be minimized by careful operation of the machine, it is highly advantageous to provide additional protection to more effectively safeguard farm personnel, livestock and equipment from injury or damage.

In the operation of applicant's previous machine, it is necessary to continuously urge the feed grinding and loading mechanism toward the stack of feed material to bring the pulverizing mechanism into engagement with the material. In a tractor-operated unit, this is accomplished by driving the tractor in reverse to move the feed grinding and loading mechanism at the rear of the wagon toward the stack of feed material. This operation is somewhat inconvenient because it requires an operator to simultaneously control the movement of the tractor and the actuation of the controls for the feed grinding and loading mechanism. Accordingly, it is highly advantageous to provide a feed grinding and loading mechanism which can operate with the wagon at a standstill to effectively grind and load the feed material into the feed compartment.

Since conventional hay stackers can produce a stack of feed material which extends up to a height of 10 or 15 feet or more, the feed loader and mixer wagon should be capable of elevating its feed grinding and loading mechanism over a wide range to engage the stack of feed material at different levels. Applicant's previous machine is somewhat limited in this respect because of the mounting of the feed grinding and loading mechanism via a set of pivot arms at the rear of the wagon. Accordingly, a mounting arrangement which permits vertical adjustment of the feed grinding and loading mechanism over a wide range of heights is desirable.

Further, in the operation of applicant's previous machine, the feed material from the loading mechanism is fed into one end of the feed compartment and mixed with other ingredients in its advance toward the other end of the compartment. The mixing is accomplished by a main conveyor mechanism located along the bottom of the feed compartment and a set of mixing augers located at the top of the feed compartment. However, the mixing of the feed material is a time consuming process. Thus, it is highly desirable to improve the speed and efficiency of the mixing operations within the feed compartment.

SUMMARY OF THE INVENTION

An object of the present invention is to provide a feed mixer apparatus capable of handling and mixing all types of livestock feed material to produce a uniform feed ration.

Another object of the invention is to provide a self-loading feed mixer apparatus capable of effectively grinding, loading, mixing and dispensing livestock feed material.

It is also an object of the invention to provide a self-loading feed mixer apparatus which includes a grinding and loading mechanism designed for enhanced safety in performance of its grinding and loading functions.

Another object of the invention is to provide a self-loading feed mixer apparatus which includes an improved feed grinding and loading mechanism designed to accomplish more effective grinding with enhanced safety.

It is another object of the invention to provide a self-loading feed mixer and transport apparatus including a feed grinding and loading mechanism which is operable to draw the feed material into the feed grinding and loading mechanism while the apparatus is at a standstill.

A further object of the invention is to provide a self-loading feed mixer and transport apparatus including a grinding and loading mechanism capable of a wide range of vertical adjustment for engagement with a stack of feed material at different levels.

It is another object of the invention to provide a feed mixer and transport apparatus in which the grinding and loading mechanism includes a flexible spout for directing ground feed material into its feed compartment while the grinding and feeding mechanism is adjusted between various vertical positions.

A further object of the invention is to provide a feed mixing and transport apparatus including an improved feed distribution arrangement for more uniform distribution of the feed material into the feed compartment.

These and other objects of the invention are accomplished in a self-loading feed handling apparatus comprising a feed compartment adapted to receive a load of feed material, a loader mechanism mounted outside of the feed compartment for pulverizing a stack of feed material and loading the feed material into the compartment, and grappling means for urging the feed material into the loader mechanism. Preferably, the loader mechanism is adjustable in height relative to the feed compartment for engagement with the stack of feed material at different levels. The loader mechanism includes a loader housing, feed pulverizing means mounted within the housing and exposed for engagement with the stack of feed material, and a screen mounted within the housing and cooperable with the pulverizing means for grinding the feed material therebetween. The loader mechanism also includes means for conveying the ground feed material from the housing into the feed compartment. Preferably, the grappling means is adapted to function as a protective cover for the loader housing. The grappling means may be embodied as a grapple fork pivotally mounted on the housing for movement toward and away from the pulverizing means and operable to engage the stack of feed material and draw the feed material into the housing.

Preferably, the invention is embodied in a feed mixer and transport apparatus having a feed compartment adapted to receive a load of feed material and a loader mechanism for grinding and loading a stack of feed material into the compartment, wherein the loader mechanism comprises a loader housing mounted outside of the feed compartment, feed pulverizing means mounted within the housing and exposed for engagement with the stack of feed material, a screen mounted within the housing and cooperable with the pulverizing means for grinding the feed material therebetween, means for conveying the ground feed material from the housing into the feed compartment, and grappling means for urging the feed material into the housing and engagement with the pulverizing means. Preferably, the loader housing is vertically adjustable in position relative to the feed compartment. The apparatus preferably includes one or more guide rails vertically mounted on the feed compartment and means for coupling the loader housing to the guide rails to permit vertical movement of the loader mechanism relative to the compartment. The apparatus also includes means for raising and lowering the housing relative to the feed compartment to allow the pulverizing means to engage the stack of feed material at different levels.

A preferred embodiment of the pulverizing means comprises a shaft mounted for rotation within the housing and a plurality of hammer units mounted on the shaft for thrashing the stack of feed material upon rotation of the shaft and grinding the feed material against the screen. Preferably, each hammer unit comprises a pair of pivotally connected links attached at one end to the shaft and provided with a hammer element at its other end for driving the feed material into the screen. The screen is preferably concave in configuration and comprises a plurality of curved screen members placed side-by-side and uniformly spaced apart.

In the preferred embodiment, the grappling means comprises a grapple fork pivotally mounted on the housing for movement toward and away from the pulverizing means and means for actuating the grapple fork to engage the stack of feed material and draw the feed material into the housing. Preferably, the grapple fork includes a plurality of claws for engaging the feed material and a shield adapted to function as a protective cover to close the open face of the housing.

Preferably, for conveying the ground feed material from the housing into the feed compartment, the grinding and loading mechanism includes a blower unit for receiving the ground feed material from the housing and a flexible discharge spout for directing the ground feed material from the blower unit into the feed compartment. In addition, auger means is located behind the screen for feeding the ground feed material into the blower unit.

In the preferred embodiment, the housing of the grinding and loading mechanism is provided with a pair of chisel bars on its opposite sides which facilitate penetration of the grinding and loading mechanism into the stack of feed material. In addition, the opposite sides of the housing are partially cut away above and below the corresponding chisel bars to enhance the penetration of the loading mechanism into the stack of feed material.

BRIEF DESCRIPTION OF THE DRAWINGS

The accompanying drawings illustrate a preferred embodiment of the present invention and, together with the description, serve to explain the principles of the invention.

FIG. 4 is a plan view, partially in section, illustrating a feed distribution unit provided at the top of the feed compartment to achieve rapid and uniform feed distribution;

FIG. 5 is a side elevation of the feed distribution unit;

FIG. 6 is a cross section of the feed mixer and transport wagon taken along line 6—6 of FIG. 2;

DETAILED DESCRIPTION OF THE PREFERRED EMBODIMENT

Figure 1:
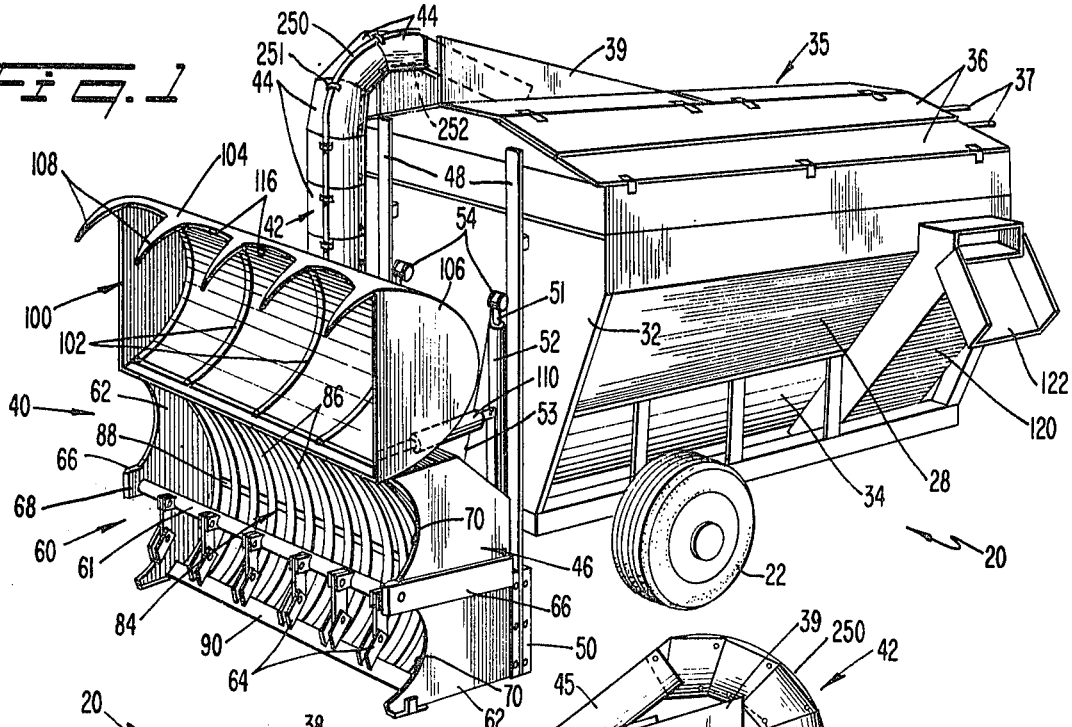
FIG. 1 is an overall perspective view of a self-loading feed mixer and transport wagon provided with a feed grinding and loading mechanism embodying the present invention.
Figure 13:
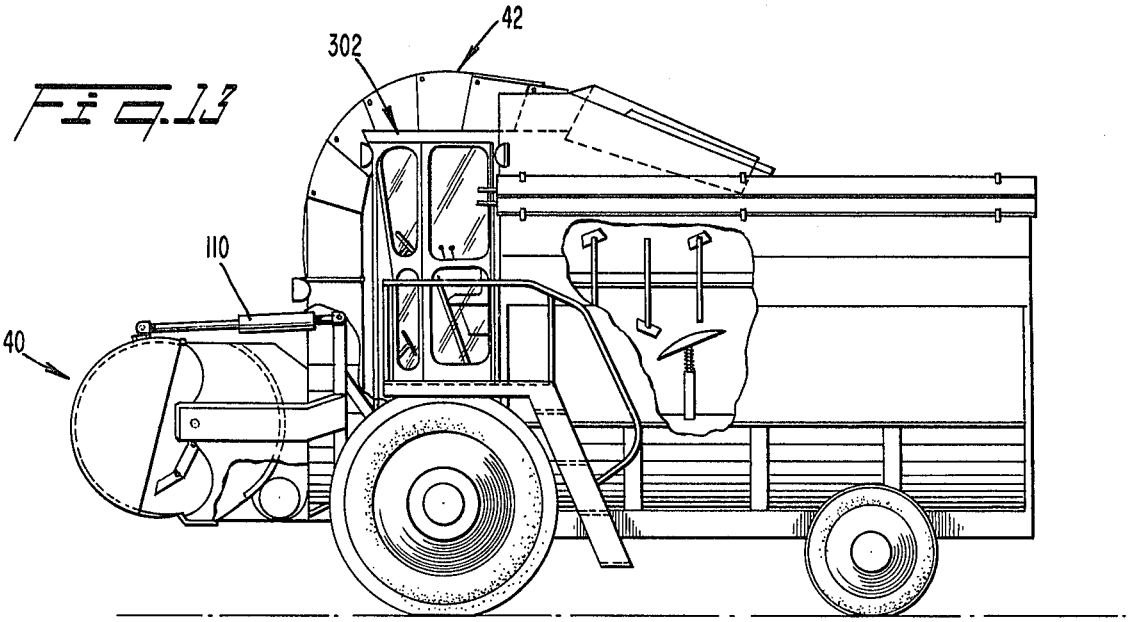
FIG. 13 illustrates a self-propelled feed mixer and transport apparatus incorporating the feed loader mechanism of the present invention.

Referring to FIG. 1, there is shown a self-loading feed mixer and transport wagon, generally 20, including a set of ground engaging wheels 22 and a trailer hitch 24 (FIG. 2) which allows the wagon to be towed by a conventional tractor or other farm vehicle. Although a tractor-drawn wagon is specifically shown and described herein, it will be understood by persons skilled in the art that the invention may also be embodied in a self-propelled machine as shown in FIG. 13.

As shown in FIGS. 4 and 6, the mixer and transport wagon includes a feed compartment defined by a pair of side walls 26 and 28, a pair of upright end walls 30 and 32 and a bottom wall 34. The lower portions of side walls 26 and 28 are slanted inwardly and aligned with the upper edges of bottom wall 34 (FIG. 6) which is rounded in configuration. The arrangement of slanted side walls and rounded bottom wall may be varied in size and configuration to accommodate different sized conveyor augers.

The wagon includes a cover, generally 35 (FIG. 1), mounted on top of the feed compartment. The cover retains feed dust in the feed compartment while loading and mixing operations are performed. It also provides protection against inclement weather conditions. Cover 35 is provided with a set of hinged panels or doors 36, each including a handle 37 at its front end for opening and closing the doors. Another set of doors 38 (FIG. 2), each including a handle 33, is provided on the opposite side of cover 35 adjacent to the front of the wagon. Door 36 and 38 provide alternate access means for inserting ingredients such as ground corn and molasses directly into the feed compartment. A shroud 39 extends upward from cover 35 behind doors 38 for receiving and directing ground feed material into the feed compartment.

Figure 2:
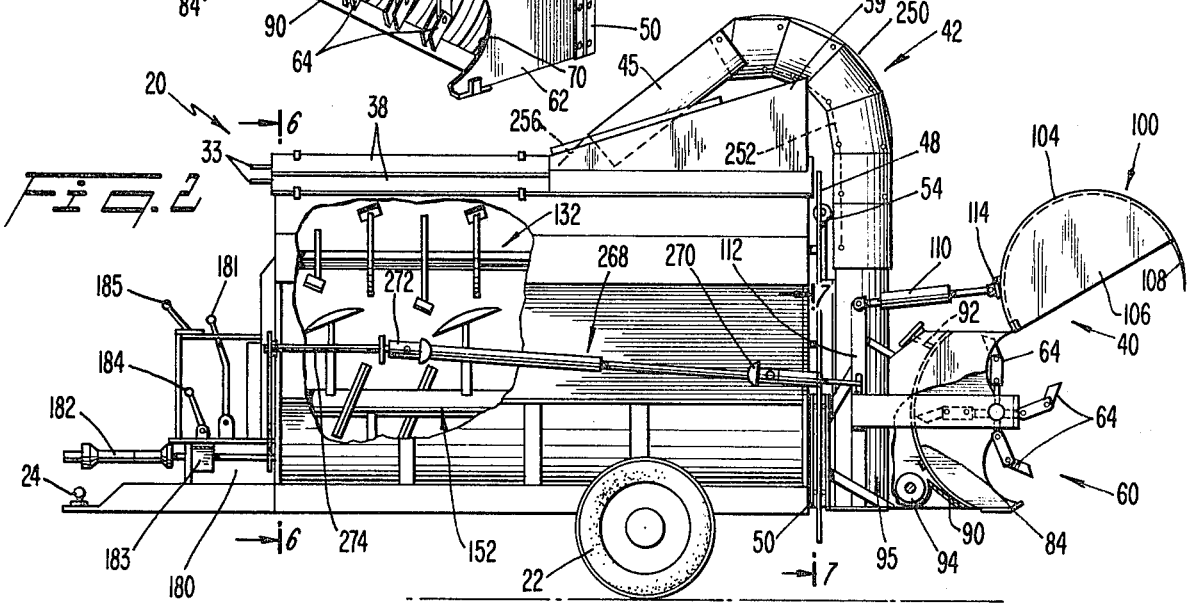
FIG. 2 is a side elevation, partially cut away, of the feed mixer and transport wagon illustrating the interior of its feed compartment and the action of a grapple fork provided on its feed grinding and loading mechainsm.

As shown in FIGS. 1 and 2, feed mixer and transport wagon 20 is provided with a feed loader mechanism, generally 40, which is adapted to pulverize and grind a stack of silage or other livestock feed material and load the feed material via an adjustable discharge spout 42 into the feed compartment. Preferably, discharge spout 42 consists of a plurality of pivotally connected sections 44. Shroud 39 includes a slidable and pivotable chute 45 (FIG. 2) which directs the ground feed material from spout 42 to the feed compartment. Feed grinding and loading mechanism 40 includes an open-faced, generally rectangular housing 46 which is adjustably mounted on wagon 20 by a pair of vertical guide rails 48 to permit vertical movement of the feed grinding and loading mechanism relative to the feed compartment. Guide rails 48 are mounted on rear wall 32 of the feed compartment and extend vertically from the top of the feed compartment to a position beneath the bottom of the compartment. Feed loader housing 46 is provided with a pair of roller support mechanisms 50 which mount the feed loader mechanism for vertical movement along guide rails 48.

Figure 7:
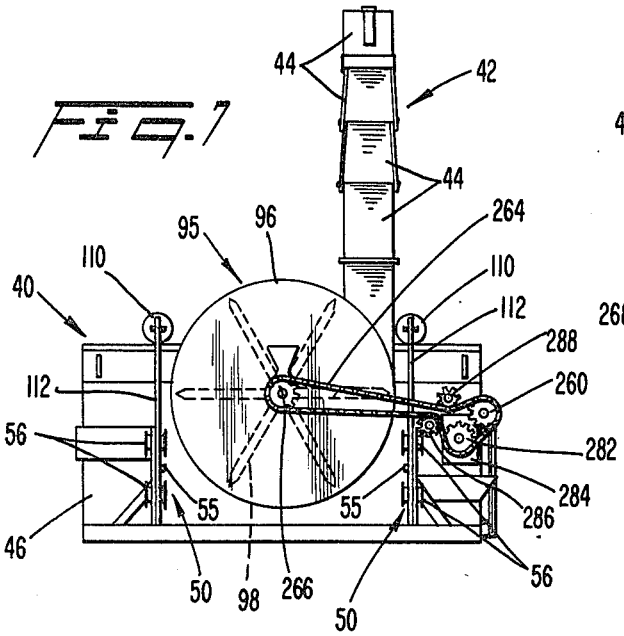
FIG. 7 is a rear view of the feed grinding and loading mechanism employed in the feed mixer and transport wagon taken along line 7—7 of FIG. 2.
Figure 8:
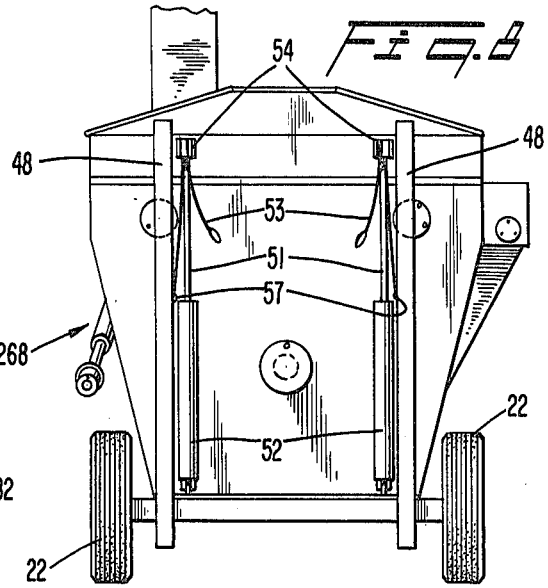
FIG. 8 is a rear elevation of the feed mixer and transport wagon with the feed grinding and loading mechanism removed.

A hydraulically driven lifting mechanism is provided for raising and lowering feed loader mechanism 40. The lifting mechanism includes a pair of hydraulic cylinders 52 (FIG. 8) mounted on rear wall 32 of the wagon. Each hydraulic cylinder includes an extendable piston rod 51 provided with a guide roller 54 rotatably mounted at its upper end. A pair of cables 53 which pass over guide rollers 54 is connected to feed loader mechanism 40 by a pair of hookup devices 55 (FIG. 7) and to guide rails 48 by a pair of anchors 57 (FIG. 8). The feed loader mechanism is moved vertically when hydraulic cylinders 52 are operated to raise or lower guide rollers 54.

Vertical guide rails 48 permit adjustment of feed grinding and loading mechanism 40 over a wide range of vertical heights to engage a stack of feed material at different levels. Consequently, the feed mixer and transport wagon can readily handle high stacks of feed material, e.g., up to heights of 10 or 15 feet or more.

Figure 9:
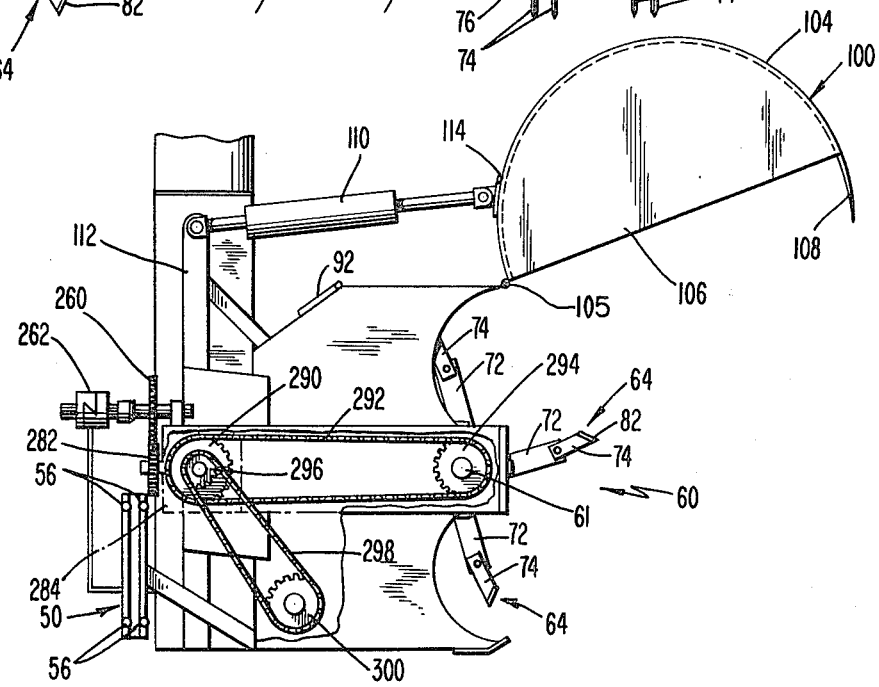
FIG. 9 is an enlarged side view, partially cut away, of the feed grinding and loading mechanism.

As shown in FIG. 9, each roller support mechanism includes one or more pairs of rollers 56 which engage the front and rear of the corresponding guide rail 48 to minimize friction and facilitate vertical movement of the grinding and loading mechanism relative to the feed compartment. Guide rails 48 may be increased or decreased in length to obtain a desired range of vertical adjustment. Preferably, each guide rail 48 comprises a flat, elongated metal beam mounted to rear end wall 32 by a set of brackets 58 which are designed to permit rollers 56 to freely pass by the brackets. Alternatively, the guide rails may be embodied as U-shaped channels which are mounted on the feed compartment and adapted to accommodate the rollers of each roller support mechanism inside the channel.

Referring to FIG. 1, feed grinding and loading mechanism 40 includes a rotatable pulverizing unit 60 comprising a rotatable shaft 61 extending between opposite sides 62 of loader housing 46 and a plurality of hammer devices 64 provided on the shaft. Shaft 61 is rotatably mounted in suitable bearings provided in a pair of penetrating bars 66 mounted on opposite side walls 62 of the loader housing. Each bar 66 is designed for strength and durability and includes a chisel-shaped forward edge 68 to facilitate penetration of loader housing 46 into the stacked feed material. Preferably, side walls 62 are partially cutaway to define recessed areas 70 located above and below the corresponding chisel bars 66 to enhance the penetration of the loader housing into the stacked feed material.

Figure 10A:
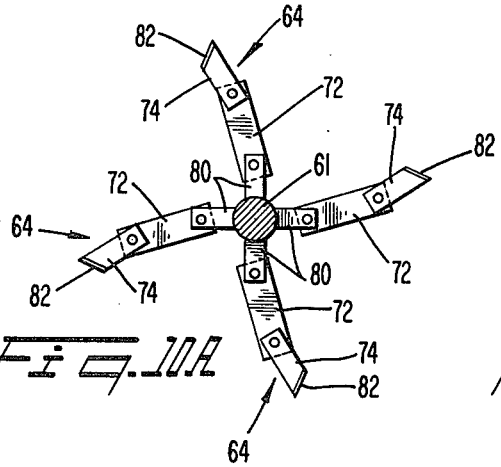
FIGS. 10A and 10B are front and side views, respectively, illustrating the structure of the pulverizing hammers provided on the rotary shaft of the feed grinding and loading mechanism.
Figure 10B:
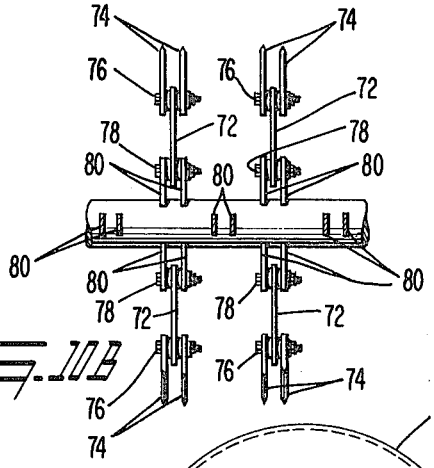

In the preferred embodiment of pulverizing unit 60, each hammer device 64 (FIGS. 10A and 10B) comprises a link 72 pivotally connected to a pair of hammers 74 by a bolt 76 received in a suitable bearing provided at its outer end. The inner end of link 72 is pivotally attached by a bolt 78 and suitable bearing to a pair of radial arms 80 provided on shaft 61. Preferably, each hammer 74 is inclined at its outer end and provided with a bevel 82 to enhance the pulverizing and grinding action. For purposes of illustration, only a single row of hammer devices 64 is shown in FIG. 1. However, as shown in FIG. 2, the hammer devices are preferably arranged in four rows which are angularly spaced by 90° about shaft 61. In addition, the hammers in adjacent rows may be offset in position with respect to each other. Alternatively, the hammers may be disposed in a spiral or helical arrangement along the shaft.

Feed grinding and loading mechanism 40 includes a curved screen 84 (FIG. 1) located within its housing 46 and spaced from shaft 61. Screen 84 is concave in configuration and comprises a plurality of curved screen members 86 arranged side by side and uniformly spaced apart. A reinforcing bar 88 is secured to the back of each curved screen member 86 to maintain the uniform spacing therebetween and enhance the rigidity of the screen. A screen support bar 90 extends between side walls 62 at the bottom of loader housing 46. As shown in FIG. 2, the lower end of screen 84 engages a suitable slot or other retainer arrangement on support bar 90, while its upper end is engaged by an adjustable retainer bracket 92 which can be tightened to firmly hold the screen in place and loosened to permit removal and replacement of the screen.

Upon rotation of pulverizing unit 60, hammer devices 64 are employed to thrash a stack of feed material (not shown) which is driven into screen 84 to grind the feed material therebetween. An auger 94 is located behind the screen for feeding the ground feed material to a blower unit 95 which conveys the material through discharge spout 42 into the feed compartment. As shown in FIG. 7, blower unit 95 includes a rounded blower housing 96 mounted on loader housing 46 which contains a six-bladed fan 98. An opening 99 (FIG. 4) in loader housing 46 permits the ground feed material to be drawn into blower housing 96 upon rotation of fan 98.

Pulverizing unit 60 is designed to achieve enhanced aggressiveness during the pulverizing and grinding operations in comparison with the previous chain-hammer design. The enhanced aggressiveness of the pulverizing unit is primarily achieved by the heavier hammer construction in conjunction with its ability to flex at only two points in contrast with the chain-hammer design which has numerous flex points. The increased weight revolving on shaft 61 provides increased momentum to enhance the stabilization of the unit while grinding feed material. The improved hammer design achieves more rapid disintegration and grinding of roughage materials because each hammer maintains a straightforward line of travel as opposed to the tendency of the chain-hammer design to shift sideways. The dual pivot action of the hammers allows each hammer to fold around shaft 61 in the event that a large piece of feed material, e.g., hay, becomes entangled in the pulverizing unit so that the hammers maintain a smaller diameter until the material is completely ground. In addition, the improved hammer design requires less maintenance than the chain-hammer design in which the hammers and chains sometimes engage each other and cause undue wear.

The screen 84 of the pulverizing unit is designed for increased grinding speed and quick replacement. Elimination of the square holes from the previous screen design is advantageous because of the tendency of tough hay or stringy material to wrap or cling around the cross members, thereby reducing the effective size of the screen apertures and sometimes clogging the apertures entirely. The use of curved, semi-circular screen members 86 allow the screen members to be more closely spaced together laterally with the additional advantage that the curved screen members do not clog, thereby enhancing the grinding speed. Reinforcing bar 88 serves to secure each curved screen member in place to maintain equal spacing between the screen members and enhanced rigidity. The improved screen is designed for convenient removal or replacement by another screen. For example, a variety of screens can be provided with different spacings between the screen members to permit selection of an appropriate screen depending upon various factors such as weather conditions and characteristics of the feed material.

Flexible spout 42 of the loader mechanism is designed to flex or change its curvature to permit the loader mechanism to be adjusted in its vertical height. Preferably, spout 42 includes an elongated leaf spring 250 (FIG. 1) which is slidably attached by suitable bracket members 251 to spout pivot sections 44 to exert a straightening effect upon the length of the spout. A cable or chain 252 is mounted outside spout 42 to control the curvature of the spout. One end of the chain is secured by a suitable connector, e.g., a set screw, to the upper spout section and is adjustably secured to each successive spout section by appropriate set screws. The screws permit the chain to be locked at desired points on each spout section to control the curvature of spout 42 and limit the amount of erection of the spout. An additional chain 256 is provided to limit the sliding movement of chute 45 relative to shroud 39 to force spout section 44 to pivot and bend leaf spring 250 to relax chain 34 and conform spout 42 to the height of the feed loader mechanism.

Feed grinding and loading mechanism 40 includes a grapple fork unit, generally 100, which enables the feed grinding and loading operations to be more effectively and safely performed. The grapple fork unit enhances the safety of the machine in operation because the amount of open-faced area is reduced and because the pulverizing mechanism can be totally enclosed by closing the grapple fork unit over the open face of the loader housing.

Preferably, grapple fork unit 100 consists of a plurality of curved steel bars 102 which support a cylindrically-shaped shield or cover member 104 provided with flat, semi-circularly shaped sidewalls 106. A suitable hinge or pivot mechanism 105 (FIG. 9) is employed to pivotally attach grapple fork unit 100 on the top wall of loader housing 46 for pivotal movement downward into its open face toward pulverizing mechanism 60. Cover member 104 and loader housing 46 are designed to completely enclose pulverizing mechanism 60 when grapple fork unit 100 is moved into the loader housing. Each curved bar 102 of the grapple fork mechanism includes a sharply pointed claw 108 which is designed to penetrate into the stack of feed material and to grasp the feed material while the grapple fork unit is closed to urge the feed material into engagement with pulverizing mechanism 60.

A pair of hydraulic cylinders 110 is provided to actuate grapple fork unit 100. Each hydraulic cylinder is mounted on an upright reinforcing bar 112 and is connected to cover member 104 of grapple fork unit 100 by a rigid crossbar 114 which effectively exerts an equal amount of force upon all grapple bars 102 when the hydraulic cylinder is actuated. Preferably, cover member 104 is notched between claws 108 to provide a set of recesses 116 which enhance the penetration of the grapple fork unit into the stack of feed material.

The action of the grapple fork unit enhances the speed of the loading operation and minimizes the requirement on the operator of the vehicle to engage the pulverizing mechanism into the stack of feed material by movement of the vehicle into the material. Cover member 104 provides a protective shield to enhance the safety of the machine in operation and to minimize the open face area of the grinding the loading mechanism to prevent the escape of dust or small particles of material, especially if wind currents are encountered.

Referring to FIG. 1, the feed mixer and transport wagon includes a discharge chute 120 extending upwardly and outwardly from sidewall 28 adjacent to the front end of the wagon. Discharge chute 120 is provided with a hinged spout 122 which is flipped downward to an open position (FIG. 1) to allow the feed material to be discharged and is flipped upward to a closed position (FIG. 3) to close the discharge chute. A discharge elevator 124 (FIG. 4) operable by a hydraulic motor 126 is mounted at the discharge end of the feed compartment for dispensing feed material from the discharge chute.

Figure 12A:
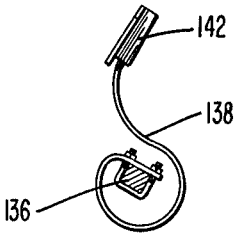
FIGS. 12A and 12B are front and side views, respectively, illustrating the structure of the mixer units provided on the mixing augers at the top of the feed compartment.
Figure 12B:
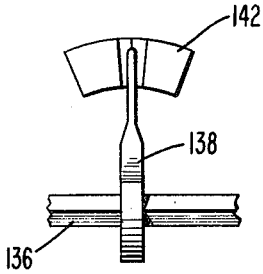

As shown in FIGS. 4 and 6, the feed mixer and transport wagon includes a pair of auger-like mixing devices 132 and 134 which extend longitudinally between end walls 30 and 32 and are rotatably mounted adjacent to side walls 26 and 28, respectively, for agitating and mixing the feed material in an upper portion of the feed compartment. Mixing auger 132 (FIG. 6) comprises an elongated, rectangular shaft 136 provided with a plurality of spiral-shaped spring arms 138 spaced apart along the shaft. Preferably, spiral-shaped spring arms 138 are arranged such that successive spring arms are angularly spaced by 90° along the length of shaft 136. An agitating element or mixing tooth 142 is secured to the free end of each spiral-shaped spring arm 138 and oriented diagonally relative to the axis of shaft 136. Preferably, as shown in FIGS. 12A and 12B, each tooth 142 comprises a screwtype auger section, which enhances the mixing action in the feed compartment. Similarly, mixing auger 134 comprises an elongated, rectangular shaft 144 including a plurality of spiral-shaped spring arms 146 spaced apart along the shaft and angularly spaced by 90° relative to each other. Spring arms 146 are provided with mixing teeth 148 oriented diagonally relative to the axis of shaft 144.

Preferably, mixing teeth 142 and 148 are oriented to move the feed material rearwardly in the feed compartment. In addition, as shown in FIG. 4, one or more spiral-shaped spring arms 150 without mixing teeth may be provided on shaft 144 above discharge elevator 124 to agitate the feed material in this area. If desired, several of the other mixing teeth 142 and 148 may be eliminated from the mixing augers. In addition, screwtype auger sections (not shown) may be spaced along shafts 136 and 144 to enhance the mixing in the feed compartment.

As shown in FIGS. 2 and 4, a paddle auger conveyor mechanism, generally 152, is rotatably mounted along the bottom of the feed compartment for advancing the feed material forwardly through the feed compartment toward a discharge area adjacent to discharge elevator 124. Conveyor mechanism 152 includes a rotatable shaft 154 extending longitudinally between end walls 30 and 32 at the bottom of the feed compartment. A first set of feed engaging paddles 156 is resiliently mounted at spaced locations along conveyor shaft 154 by a corresponding set of paddle support arms 158 at the rear of the feed compartment. Each paddle 156 is non-rotatably mounted on its support arm 158 and oriented diagonally relative to the axis of shaft 154. A second set of feed engaging paddles 160 is resiliently mounted at spaced locations along conveyor shaft 154 on a corresponding set of paddle support arms 162 at the front of the feed compartment. Each paddle 160 is rotatably mounted on its support arm 162 and normally oriented diagonally relative to the axis of shaft 154. Each successive paddle and support arm is angularly displaced by 90° with respect to the adjacent paddles and support arms on shaft 154.

Figure 11A:
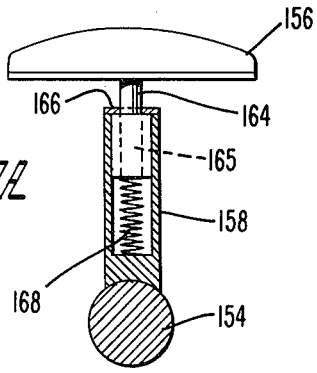
FIGS. 11A and 11B are front and side views, respectively, illustrating the structure of the feed engaging paddles mounted on the conveyor at the rear of the feed compartment.
Figure 11B:
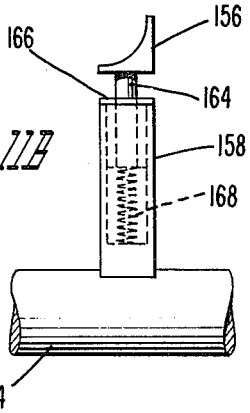

Referring to FIGS. 11A and 11B, each paddle 156 at the rear of the feed compartment has a generally flat face for engaging and advancing feed material upon rotation of conveyor shaft 154 and a curved outer edge which allows the paddle to freely rotate past the inner curved surface of bottom wall 34 of the feed compartment. Paddle 156 is secured, e.g., by welding, to a round shaft or stem 164 having a square tube 165 welded to its lower end and slidably and non-rotatably received within support arm 158 which is hollow and square in cross section. A collar 166 is welded on top of arm 83 to limit the outward movement of paddle 156 and stem 164. In addition, a compression spring 168 located within hollow support arm 158 engages stem 164 to normally urge paddle 156 outward relative to conveyor shaft 154. Paddle 156 and stem 164 are slidable radially inward toward shaft 154 to relieve the pressure on the livestock feed advanced through the feed compartment. Spring 168 serves to normally urge paddle 156 into close engagement with bottom wall 34 of the feed compartment and to allow the paddle to slide radially inward relative to the conveyor shaft to relieve pressure on the livestock feed material as it is advanced. A more detailed description of the structure and operation of conveyor paddles 160 and support arms 162 at the front of the feed compartment is contained in applicant's co-pending U.S. application Ser. No. 78,027, which is incorporated herein by reference.

In the preferred embodiments, a total of 16 feed engaging paddles 156 and 160 are provided on conveyor shaft 154. At the rear of the wagon, non-rotatable paddles 156 are employed to advance the feed material. For example, 8 or 10 of such paddles may be provided on the conveyor shaft. At the front of the feed compartment, rotatably mounted paddles 160 are employed to advance the feed material. For example, 6 or 8 of such paddles may be employed on the conveyor shaft. Two or more paddles 160 located adjacent to discharge elevator 124 are reversed in diagonal orientation relative to the conveyor shaft. These reversed paddles serve to relieve pressure on the feed material advanced to the discharge area and to prevent the feed material from being forced against front wall 30 of the feed compartment.

As shown in FIG. 4, feed mixer and transport wagon 20 is provided with a feed distributing auger unit, generally 170, which is mounted on cover 35 of the wagon. Feed distributing unit 170 comprises a screw-type auger 172 rotatably mounted at end walls 30 and 32 and located in a feed receiving trough 174 suspended from the roof of the wagon. As shown in FIG. 5, one side of trough 174 is partially cut away to provide a downwardly inclined ledge 176 which gradually exposes auger 172. When feed material is supplied via discharge spout 42 into the trough, a portion of the feed material immediately overflows from trough 174 into the feed compartment at the rear of the wagon. In addition, as auger 172 is rotated to convey the remainder of the feed material toward the front of the wagon, a portion of the feed material is spilled and sprinked into the center of the feed compartment and the remainder of the feed material is spilled at the front of the feed compartment. The purpose of this feed distributing unit is to achieve an instantaneous and uniform mix by spilling and sprinkling material along the entire length of the feed compartment so that the material is instantly mixed with other ingredients, even when small amounts are added to a full load, as opposed to merely waiting for the feed material to work its way forward when loaded into the rear of the feed compartment.

Referring to FIG. 2, feed mixer and transport wagon 20 has a conventional power transmission 180 operable by a control lever 181, which may be coupled to the power take-off of a tractor (not shown) via a coupling shaft 182 to drive the mixing augers and conveyor mechanism of the wagon via a sprocket and chain drive system (FIG. 3) mounted on front wall 30 of the wagon. A separate clutch assembly 183 provided with a control lever 184 is drivingly connected to shaft 182 to supply power to feed loader mechanism 40. A set of hydraulic controls 185 (FIG. 2) is provided for operating hydraulic cylinders 52 and 110.

Figure 3:
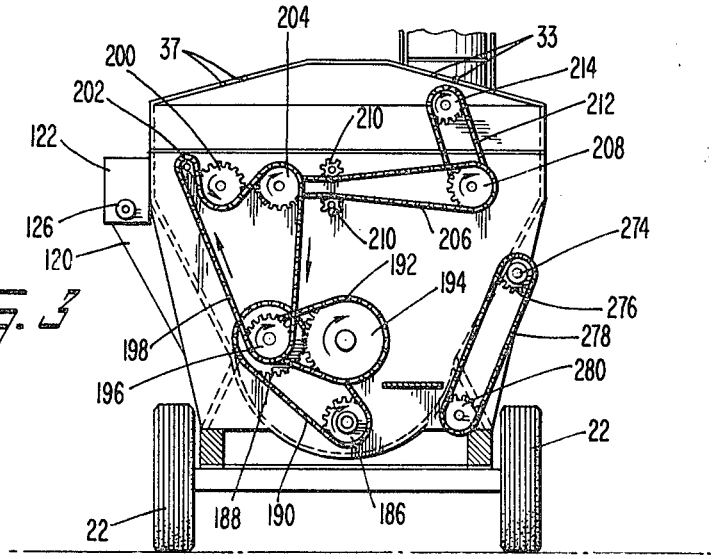
FIG. 3 is a front elevation illustrating the drive chain assembly of the feed mixer and transport wagon.

As shown in FIG. 3, the drive system includes a sprocket 186 driven by the output of transmission 180 and coupled to a sprocket assembly 188 via a drive chain 190. Sprocket assembly 188 includes a small sprocket (not shown) coupled via a chain 192 to drive sprocket 194 for the paddle conveyor mechanism 152 (FIG. 2) at the bottom of the feed compartment. Sprocket assembly 188 includes an intermediate sprocket 196 coupled via a chain 198 to drive a sprocket 200 for mixing auger 134 at the top of the feed compartment. Drive chain 198 travels around a stationary idler sprocket 202 and a reversing sprocket 204 to obtain rotation of sprocket 200 in a counterclockwise direction. Sprocket 204 is mounted for rotation with another sprocket of identical size (not shown) which is coupled via a chain 206 to drive sprocket 208 for mixing auger 132 (FIG. 2). Drive sprocket 208 is driven in a clockwise direction. A pair of spring-biased idler sprockets 210 engage drive chain 206 to provide the desired tension on the chain. Drive sprocket 208 is mounted for rotation with another sprocket of identical size (not shown) which is coupled via a chain 212 to a drive sprocket 214 for auger 172 (FIG. 4) of the feed distributing unit.

Referring to FIG. 6, conveyor shaft 154 is driven in a clockwise direction to advance the feed material forwardly in the compartment via feed engaging paddles 156 and 160. Mixing auger 132 is rotated in a clockwise direction such that each ot its mixing teeth 142 approaches side wall 26 while moving in a generally downward direction. Similarly, mixing auger 134 is rotated in a counterclockwise direction such that each of its mixing teeth 148 approaches side wall 28 while moving in a generally downward direction. This downward motion of the mixing teeth relative to the side walls avoids clogging of the feed material against the side walls of the feed compartment. Once mixing teeth 142 and 148 reach their lowermost positions in the feed compartment, the teeth move upwardly over conveyor mechanism 152 to achieve a uniform mixture of the feed material. Auger 172 of the feed distributing unit is also rotated to advance ground feed material from discharge spout 42 along trough 174 to spill and sprinkle the feed material over side wall 176 of the trough into the feed compartment.

Referring to FIGS. 7 and 9, feed loading mechanism 40 includes a drive sprocket 260 on the back of housing 46 driven via an overriding clutch 262 and coupled by a chain 264 to a drive sprocket 266 for blower fan 98. Drive sprocket 260 is coupled to clutch 183 (FIG. 2) via a telescoping power shaft 268 including a universal coupling element 270 connected to the sprocket. An additional universal coupling element 272 is provided to couple telescoping power shaft 268 to a rotary shaft 274 mounted in suitable bearings on the wagon. As shown in FIG. 3, shaft 274 is driven by sprocket 276 coupled via a chain 278 and a sprocket 280 to the output of clutch 183. Sprocket 260 is also coupled via chain 264 to sprocket 282 which drives a right-angled gear box 284. An idler sprocket 286 and an adjustable sprocket 288 are provided to control the tension in chain 264. As shown in FIG. 9, gear box 284 includes a large sprocket 290 coupled via a chain 292 to a sprocket 294 which drives shaft 61 to operate pulverizing unit 60. In addition, the gear box includes a small sprocket 296 coupled via a chain 298 to a drive sprocket 300 for auger 94 (FIG. 2) of the feed loader mechanism.

In the operation of feed mixer and transport wagon 20, the wagon is coupled to a tractor and moved to a position with its feed loader mechanism 40 facing a stack of hay, silage or other feed material. Hydraulic cylinders 52 are actuated to adjust the feed loader mechanism to the desired level. Transmission control lever 181 is engaged in its forward drive position to transmit power from shaft 182 to paddle conveyor mechanism 152 and to mixing augers 132 and 134. In addition, hydraulic cylinders 110 are actuated to pivot grapple fork unit 100 toward the open face of loader housing 46. Claws 108 penetrate into the feed material and drive the material into the open-faced loader housing. Control lever 184 is actuated to engage clutch assembly 183 (FIG. 2) to transmit power from shaft 182 to the feed loader mechanism to rotate shaft 61, pulverizing hammers 64, auger 94 and blower fan 98. The pulverizing hammers thrash the stack of feed material and grind the feed material against screen member 84. The ground feed material is passed through screen member 84 to auger 94 which is rotated to advance the ground feed material toward opening 99 (FIG. 4) in housing 46. By action of fan 98 and auger paddle 246, the ground feed material is fed into blower unit 95 and discharged via spout 42 into the feed compartment. Feed distributing unit 170 serves to uniformly distribute the ground feed material along the length of the feed compartment.

Simultaneously, paddle conveyor mechanism 152 is rotated to move the feed material forwardly along the bottom of the wagon, while mixing augers 132 and 134 are rotated to uniformly distribute and mix the feed material within the compartment. The action of feed engaging paddles 156 and 160 together with mixing teeth 142 and 148 tends to break up any large chunks of feed material. After the silage is loaded into the feed compartment, clutch assembly 180 is disengaged to terminate rotation of paddle conveyor mechanism 152 and mixing augers 132 and 134. Overriding clutch 262 (FIG. 9) allows the rotation of shaft 61, pulverizing hammers 64, auger 94 and blower fan 98 to continue until the momentum of these components is dissipated. Hydraulic cylinders 52 are actuated to return feed loader mechanism 40 to an inoperative position where, if desired, it may be locked in place by a suitable latching device (not shown).

When it is desired to unload the feed material from the wagon, transmission control lever 181 is engaged in its forward drive position to rotate paddle conveyor mechanism 152 and mixing augers 132 and 134 and advance feed material forwardly toward the discharge area of the wagon. Clutch assembly 183 is disengaged to preclude operation of feed loading mechanism 40 and blower unit 95. Hydraulic motor 126 (FIG. 4) is activated to operate elevator 124 which conveys the feed material upwardly along discharge chute 120. Discharge spout 122 is flipped downward to allow the feed material to be dispensed into a feed bunk or other storage bin or to dump the feed material on the ground alongside the wagon.

As shown in FIG. 13, the present invention may be embodied in a self-propelled feed mixer and transport vehicle in which feed loader mechanism 40 is mounted in front of a cab 302 for the operator of the vehicle. This arrangement has the advantage that the loader mechanism is clearly within the view of the vehicle operator. Flexible discharge spout 42 extends upwardly over the front of the vehicle into its feed compartment which contains a conveyor mechanism and mixing augers identical to the embodiment described above. It is contemplated that the self-propelled feed mixer and transport apparatus may be especially suitable for use in large-scale livestock feeding installations.

The invention provides a self-loading feed mixer and transport wagon which advantageously allows a stack of feed material to be ground, loaded, mixed and dispensed via a single piece of farm machinery. The wagon eliminates the need for an expensive tub grinder previously required for grinding hay. In addition, the improved structure of the feed loader mechanism provides enhanced safety and effectiveness in feed loading operations. The feed distributing unit and improved mixing augers achieve more rapid and uniform distribution of feed material within the wagon.

The present invention is not limited to the specific details shown and described, and modifications may be made in the self-loading feed mixer and transport wagon without departing from the principles of the invention.

I claim:

1. A feed transport apparatus adapted to be transported on the ground and positioned adjacent to a stack of feed material, said feed transport apparatus having a feed compartment adapted to receive a load of feed material and a loader mechanism for grinding and loading the stack of feed material into the compartment, said loader mechanism comprising:

an open-faced loader housing mounted outside of said feed compartment;

feed pulverizing means mounted within said open-faced loader housing and exposed via said open-faced housing for engagement with the stack of feed material;

a screen mounted within said housing and cooperable with said pulverizing means for grinding the feed material therebetween;

means for conveying the ground feed material from said housing into said feed compartment;

grappling means pivotally mounted on top of said open-faced loader housing and adapted to pivot downward for urging the feed material from the stack into said housing and engagement with said pulverizing means;

means for pivoting said grappling means downward relative to said housing into the stack of feed material to draw the feed material into said housing; and said loader housing being vertically adjustable in position relative to said feed compartment to permit said loader mechanism to operate on the stack of feed material at different levels.

2. The apparatus of claim 1, wherein said grappling means comprises:

a grapple fork including a protective cover member provided with a plurality of claws adapted to penetrate into the stack of feed material upon downward pivotal movement of said cover member relative to said housing.

3. The apparatus of claim 1, wherein said grappling means comprises:

a grapple fork including a plurality of curved support members;

a cylindrically-shaped shield mounted on said curved support members and provided with flat semi-circularly shaped side walls; and each curved support member including a claw adapted to penetrate into the stack of feed material upon downward pivotal movement of said grapple fork to urge the feed material into engagement with said pulverizing means.

4. The apparatus of claim 1, which includes:

one or more guide rails vertically mounted on said feed compartment; and means for coupling said housing to said guide rails to permit vertical movement of said loader mechanism relative to said compartment.

5. The apparatus of claim 1, which includes:

means for raising and lowering said housing relative to said feed compartment to allow said pulverizing means to engage the stack of feed material at different levels.

6. The apparatus of claim 5, wherein said conveying means comprises:

a blower unit for receiving the ground feed material from said loader housing; and a flexible discharge spout for directing the ground feed material from said blower unit into said feed compartment.

7. The apparatus of claim 6, which includes:

auger means located adjacent to said screen for feeding the ground feed material to said blower unit.

8. The apparatus of claim 1, wherein said pulverizing means comprises:

a shaft mounted for rotation within said housing; and a plurality of hammer devices mounted on said shaft for thrashing the stack of feed material upon rotation of said shaft and grinding the feed material against said screen.

9. The apparatus of claim 8, wherein each hammer device comprises:

a link arm pivotally attached at one end to said shaft and a hammer element pivotally attached at the other end of said link arm for driving the feed material into said screen.

10. The apparatus of claim 9, wherein:

said screen is concave in configuration and comprises a plurality of curved screen members arranged side-by-side and uniformly spaced apart.

11. A feed mixer and transport apparatus adapted to be transported on the ground and positioned adjacent to a stack of feed material, said feed transport apparatus having a feed compartment adapted to receive and mix a load of feed material and a feed loader mechanism for grinding and loading the stack of feed material into the compartment, said feed loader mechanism comprising:

a loader housing mounted outside of said feed compartment and provided with an open face for receiving feed material from the stack;

a shaft rotatably mounted within said housing and exposed via said open face to the stack of feed material;

a plurality of pulverizing hammers mounted on said shaft for thrashing the stack of feed material upon rotation of said shaft;

a screen mounted within said housing at a position spaced from said rotatable shaft and cooperable with said pulverizing hammers for grinding the feed material therebetween;

means for conveying the ground feed material from said housing into said feed compartment;

grapple means pivotally mounted on said loader housing above its open face and adapted to pivot downward to urge the feed material from the stack through said open face of said housing into engagement with said pulverizing hammers;

means for pivoting said grapple means downward toward said open face of said housing and into the stack of feed material to draw the feed material into said housing; and said loader housing being vertically adjustable in position relative to said feed compartment to permit said loader mechanism to operate on the stack of feed material at different levels.

12. The apparatus of claim 11, wherein said grapple means comprises:

a grapple fork including a plurality of concave support members;

a concave shield mounted on said support members and provided with closed sidewalls; and each support member terminating in a claw adapted to penetrate into the stack of feed material upon downward pivotal movement of said grapple fork to urge the feed material into engagement with said pulverizing means.

13. The apparatus of claim 11, which includes:

a set of vertical guide rails mounted on said feed compartment; and means for coupling said housing to said guide rails to permit vertical movement of said housing relative to said compartment.

14. The apparatus of claim 11, which includes:

means for raising and lowering said housing relative to said feed compartment to allow said pulverizing hammers to engage the stack of feed material at different levels.

15. The apparatus of claim 14, wherein said conveying means comprises:

a blower unit for receiving the ground feed material from said housing; and a flexible discharge spout for directing the ground feed material from said blower unit into said feed compartment.

16. The apparatus of claim 15, wherein said flexible spout comprises:

a plurality of pivotally connected sections which allow said spout to flex into different configurations upon vertical movement of said loading mechanism relative to said feed compartment.

17. The apparatus of claim 15, which includes:

auger means located adjacent to said screen for feeding the ground feed material to said blower unit.

18. The apparatus of claim 11, wherein each pulverizing hammer comprises:

a link arm pivotally attached at one end to said shaft and a hammer element pivotally attached at the other end of said link arm for driving the feed material into said screen.

19. The apparatus of claim 18, wherein:

said screen is concave in configuration and comprises a plurality of curved screen members arranged side-by-side and uniformly spaced apart.

20. The apparatus of claim 11, wherein:

said grapple means is adapted to function as a protective cover to close said open face of said loader housing.

21. The apparatus of claim 11, wherein said grapple means comprises:

a cover member pivotally attached to the top of said housing and provided with a plurality of claws for engaging the feed material upon downward pivotal movement of said cover member relative to said housing to draw the feed material into said housing toward said pulverizing hammers.

22. The apparatus of claim 11, which includes:

a pair of chisel bars mounted on opposite sides of said housing to facilitate penetration of said grinding and loading mechanism into the stack of feed material.

23. The apparatus of claim 22, wherein:

said opposite sides of said housing are partially cut away above and below the corresponding chisel bars to enhance the penetration of said loader mechanism into the stack of feed material.

24. The apparatus of claim 11, which includes:

an auger unit extending longitudinally above said feed compartment for receiving ground feed material from said loader mechanism and uniformly distributing said feed material into said feed compartment.

* * * * *